United States Patent [19]

Mizutani

[11] 4,367,641

[45] Jan. 11, 1983

[54] APPARATUS FOR BENDING AND TWISTING ELONGATED PIECES

[75] Inventor: Tomihiko Mizutani, Anjyo, Japan

[73] Assignee: Inoue MTP Kabushiki Kaisha, Nagoya, Japan

[21] Appl. No.: 180,405

[22] Filed: Aug. 22, 1980

[30] Foreign Application Priority Data

Jan. 21, 1980 [JP] Japan ..... 55-5580

[51] Int. Cl.[3] ..... B21D 11/14

[52] U.S. Cl. ..... 72/65; 72/166; 72/307; 72/64

[58] Field of Search ..... 72/307, 299, 298, 311, 72/384, 386, 306, 64, 65, 166, 169

[56] References Cited

U.S. PATENT DOCUMENTS

| | | | |
|---|---|---|---|
| 1,463,594 | 7/1923 | Rust | 72/64 |
| 2,233,869 | 3/1941 | Lukács | 72/299 |
| 2,944,582 | 7/1960 | Ahonen | 72/298 |
| 3,058,511 | 10/1962 | Phillips | 72/299 |
| 3,280,607 | 10/1966 | Esken et al. | 72/299 |
| 3,421,351 | 1/1969 | Newman et al. | 72/64 |
| 3,673,844 | 7/1972 | Heijenga | 72/298 |
| 3,678,723 | 7/1972 | Tenpas | 72/299 |

*Primary Examiner*—Daniel C. Crane

*Attorney, Agent, or Firm*—Armstrong, Nikaido, Marmelstein & Kubovcik

[57] ABSTRACT

A method and apparatus for bending an elongated piece, wherein the piece is fed to and held by feeding rolls and bending rolls which are spaced from each other, the piece is bent by displacing the bending rolls in directions perpendicular to the longitudinal axis of the piece and is twisted by rotating the bending rolls about the longitudinal axis of the piece.

5 Claims, 9 Drawing Figures

| Section | $X_1$ | $X_2$ | $X_3$ | $X_4$ | $X_5$ | $X_6$ | $X_7$ | $X_8$ | $X_9$ |
|---|---|---|---|---|---|---|---|---|---|
| Li (mm) | 150 | 100 | 200 | 100 | 250 | 100 | 200 | 100 | 150 |
| Ry(mm) | 1000 | — | 1600 | — | 2500 | — | 1600 | — | 1000 |

| Section | $X_1$ | $X_2$ | $X_3$ | $X_4$ | $X_5$ |
|---|---|---|---|---|---|
| Li(mm) | 250 | 100 | 650 | 100 | 250 |
| Rz(mm) | 1600 | — | 5000 | — | 1600 |

| Section | $X_1$ | $X_2$ | $X_3$ | $X_4$ | $X_5$ |
|---|---|---|---|---|---|
| Li(mm) | 300 | 100 | 550 | 100 | 300 |
| 0 | 0° | — | 5° | — | 0° |

APPARATUS FOR BENDING AND TWISTING ELONGATED PIECES

BACKGROUND OF THE INVENTION

This invention relates to an apparatus for bending an elongated piece, such as a rod or a bar, and particularly to an apparatus for successively bending and twisting such an elongated piece in directions perpendicular to and about the longitudinal axis of the piece.

The piece, i.e., the elongated member to be bent, referred to hereinafter is a decorative molding which is applied to the outer side faces of a vehicle body of an automobile to protect the body from the formation of undesirable scratches which would otherwise appear on the body, for example when the automobile accidentally comes into contact with another automobile. However,in this invention, the piece is not limited to such a decorative molding, and the invention is applicable to any kind of long or elongated products.

It is necessary to bent and twist the decorative molding so as to have curved configurations corresponding to the curved outer side faces of an automobile body to which the decorative moldings are to be applied, so that the moldings can be closely adhered to the side faces of the automobile body. Usually, the decorative molding is bent in horizontal and vertical directions which are perpendicular to the longitudinal axis of the molding. In addition, the molding is usually twisted about the longitudinal axis thereof.

The present invention is directed to an apparatus for successively bending twisting an elongated piece in horizontal and vertical directions perpendicular to and about the longitudinal axis of the piece.

SUMMARY OF THE INVENTION

The primary object of the present invention is to provide a bending method and apparatus which can bend an elongated piece in desired directions by a single operation.

Another object of the present invention is to provide a bending apparatus which can successively bend an elongated piece.

Still another object of the present invention is to provide a bending apparatus which can effectively and simply bend an elongated piece and which can be automatically controlled by a numerical control machine which is per se known.

BRIEF DESCRIPTION OF THE DRAWINGS

The invention will become more apparent from the detailed description of the preferred embodiment which is illustrated in the accompanying drawings in which.

DETAILED DESCRIPTION OF THE INVENTION

Figure 1A:
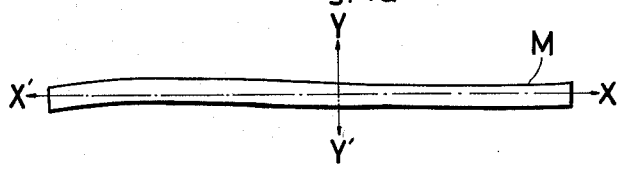
FIG. 1*a* is a plan view of a decorative molding which is to be bent.
Figure 1B:
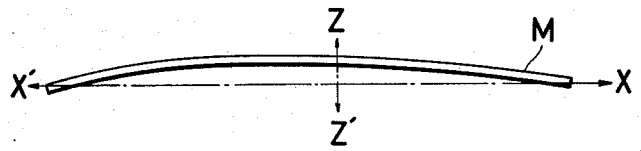
FIG. 1*b* is a side elevational view of FIG. 1*a;*
Figure 2:
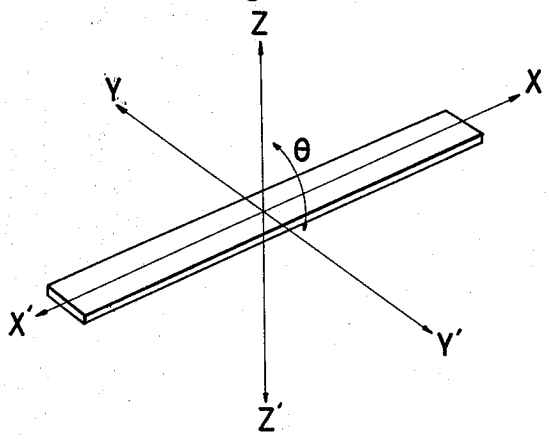
FIG. 2 is a perspective view of a decorative molding which is to be twisted.

The piece, i.e., the decorative molding M is required to be bent in a horizontal direction Y—Y′ (FIG. 1*a*) and in a vertical direction Z—Z′ (FIG. 1*b*). These directions are both perpendicular to the longitudinal axis X—X′ of the molding M. In addition, the molding M must be twisted by an angle $\theta$ (FIG. 2) about the longitudinal axis X—X′.

Figure 3:
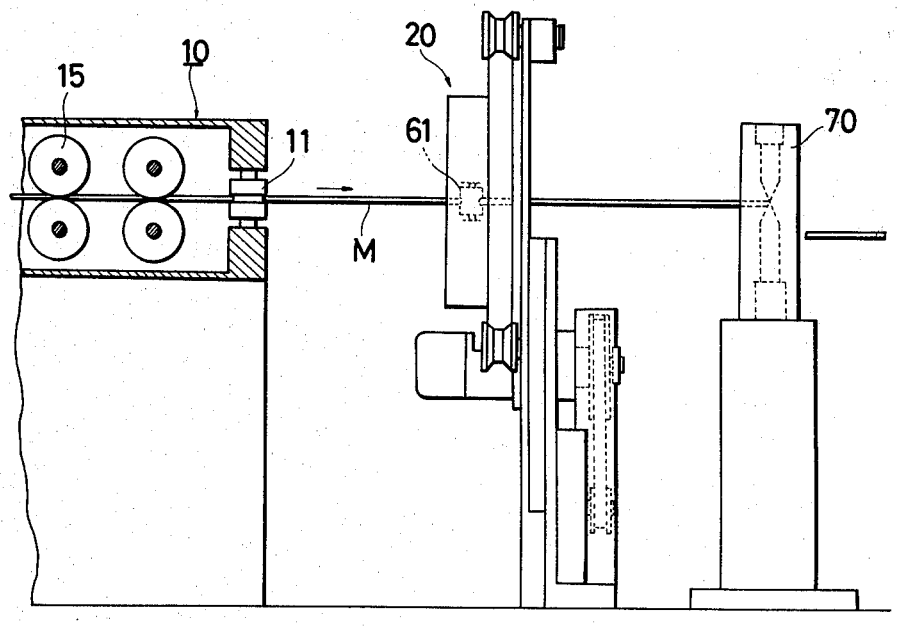
FIG. 3 is a side elevational view of a bending apparatus, according to the present invention.

The apparatus essentially comprises a feeding unit 10 having feeding rolls 11 and a bending unit 20 having rolls 61, as illustrated in FIG. 3. The piece, i.e., the decorative molding M is successively brought into an operational position in which the molding M is located between the feeding rolls 11 and the bending rolls 61 to be bent and/or twisted. The distance between the bending rolls and the feeding rolls depends on the desired length of one molding M. The molding M is held by the feeding rolls 11 and the bending rolls 61. When the molding M is bent or twisted, the feeding rolls serve as a stationary support and the bending rolls 61 serve as a movable support. That is, the bending rolls 61 can be not only moved in a horizontal direction Y—Y′ and in a vertical direction Z—Z′ but also rotated about the longitudinal axis X—X′ of the molding M. The movement of the bending rolls in the directions Y—Y′ and Z—Z′ and the rotation thereof can be independently effected. A predetermined length of the bent and twisted molding is cut by a cutter 70. Thus, decorative molding, i.e., products can be successively manufactured.

Figure 4:
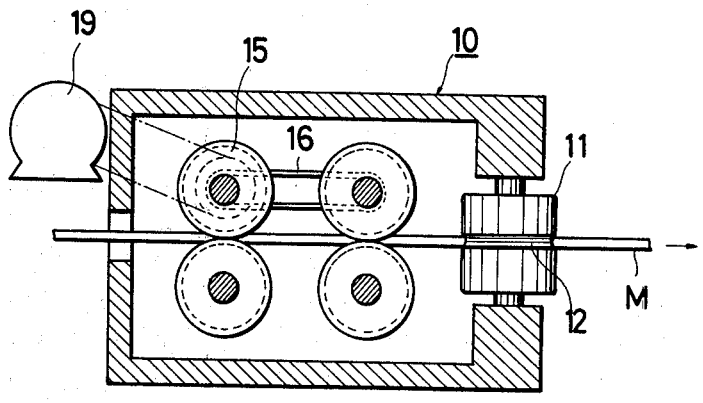
FIG. 4 is a partially sectioned side elevational view of a feeding unit illustrated in FIG. 3.

The feeding unit 10 has a pair of feeding rolls 11 which successively feed the molding M to the bending rolls 61 of the bending unit 20 (FIG. 3), as illustrated in FIG. 4. The feeding unit 10 also has driving rolls 15 which are connected to and driven by a driving motor 19. The molding M is moved by the driving rolls 15. The feeding rolls 11 are provided with feeding grooves 12 in which the molding M is fitted. The numeral 16 designates a chain. Preferably, the axes of the driving rolls 15 are perpendicular to the axes of the feeding rolls 11, so that the molding M can be precisely located in a predetermined position.

The bending unit 20 is spaced at a predetermined separation from the feeding unit 10 and is aligned on a feeding line. The bending unit 20 includes a bed 21, a first slide 30, a second slide 40, a frame 50 and a bending roll holder 60. The bed 21 is secured to the base 22 and supports the first slide 30 at the center portion of the bed. The first slide 30 has upper and lower shaft 31, 31 secured thereto, which are slidably supported by bearings 29, 29 provided in the bed 21. The slide 30 can be moved by a ball screw device 25 or a hydraulic cylinder (not shown), in the direction of horizontal axis Y—Y' prependicular to the feeding direction X—X' of the molding M. The device 25 is driven by a drive such as a motor 26 which is provided in the bed 21.

The second slide 40 is movable in the direction of vertical axis Z—Z' perpendicular to the axis X—X', relative to the first slide 30. That is, the second slide 40 can be moved in the vertical directions on the first slide 30 by means of a ball screw device 35 or a cylinder device (not shown), provided in the first slide 30. As can be understood from the above discussion, the second slide 40 is thus movable not only in the directions Y—Y' but also in the directions Z—Z', relative to the molding M. The device 35 is driven by a motor 36 which is supported by the first slide 30. The second slide 40 has flanges 41, 41 which are fitted in corresponding guide grooves 37, 37 of the first slide, so that the second slide 40 slides along the guide grooves 37, 37 with the help of the flanges 41, 41.

The frame 50 is rotatable about the axis X—X', in directions designated by an arrow d, relative to the first slide 30. For the purpose of this rotational movement, the disk-shaped frame is provided, on its outer periphery, with teeth 51 which can be engaged by supporting gears 46 supported by the second slide 40. The frame 50 has an opening **50*a* in which the bending roll holder 60 is arranged. The peripheral teeth 51 of the frame 50 are engaged also by a drive gear 45 which is supported by the second slide 40 and which is driven by a motor 45*a*, so that the frame 50** can rotate.

Figure 5:
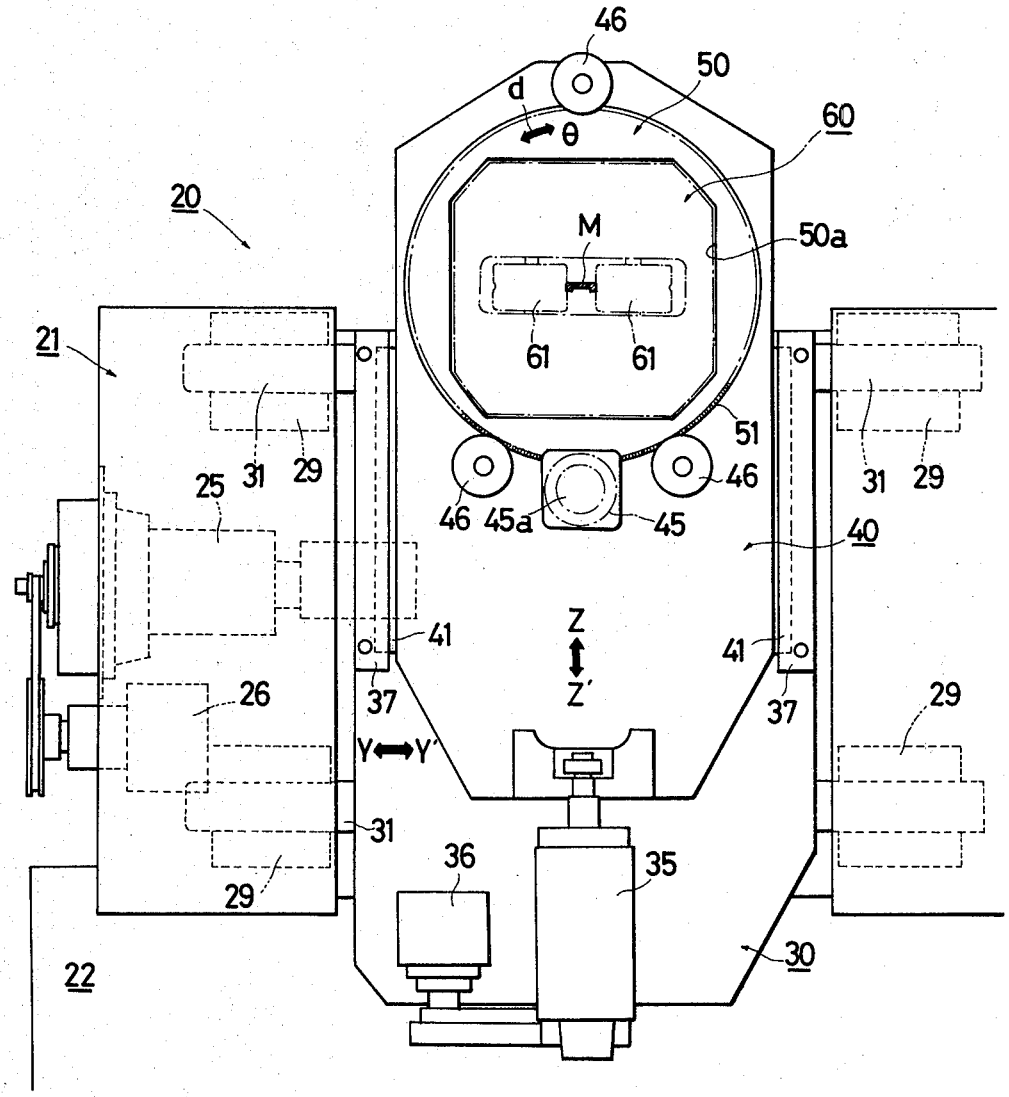
FIG. 5 is an elevational view of a bending unit of a bending apparatus, according to the present invention.
Figure 6:
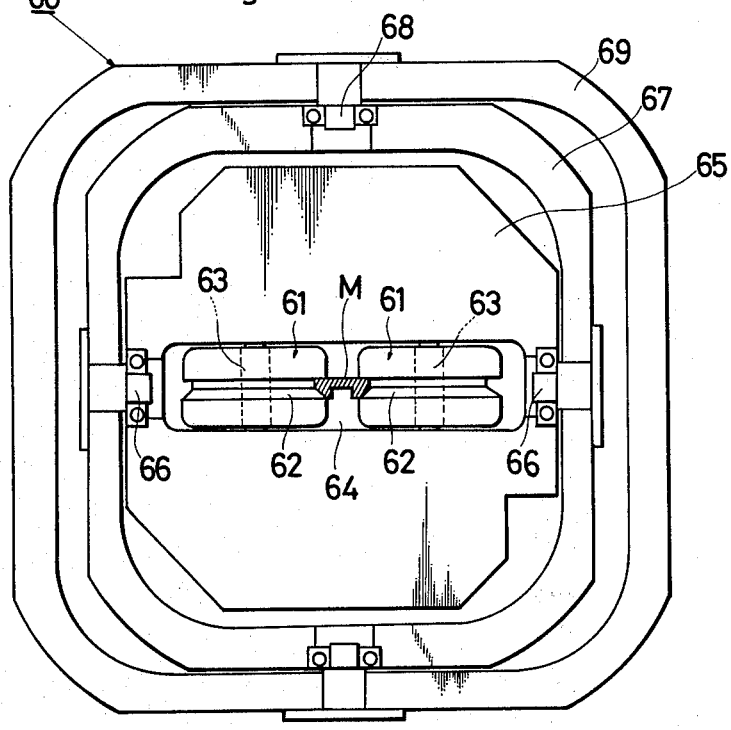
FIG. 6 is an enlarged elevational view of a roll holder.
Figure 7A:
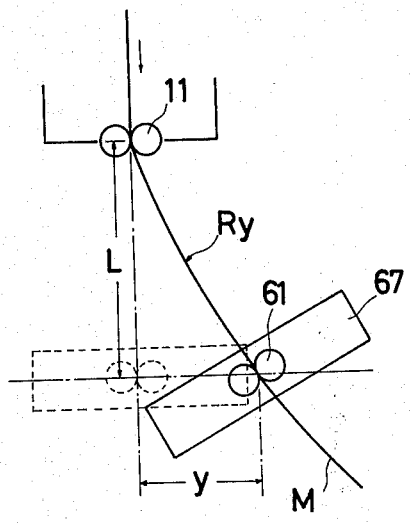
FIG. 7*a* is a schematically illustrated plan view of a bending apparatus in which an elongated piece is bent in a horizontal direction.
Figure 7B:
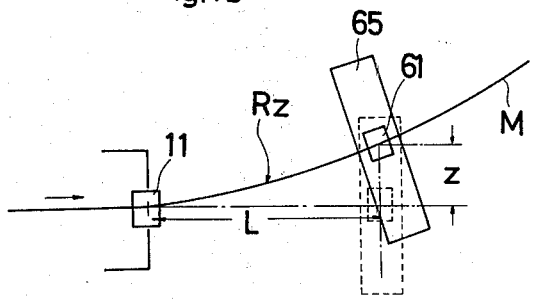
FIG. 7*b* is a schematically shown side elevational view of a bending apparatus in which an elongated piece is bent in a vertical direction.
Figure 7C:
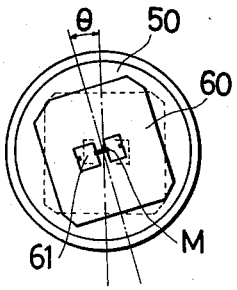
FIG. 7*c* is a schematical elevational view of a bending apparatus in which an elongated piece is twisted about its longitudinal axis.

The holder 60 which is fitted in the opening **50*a* of the frame 50 supports the bending rolls 61 in such a way that the rolls 61 are movable in directions perpendicular to the axis X—X' of the molding M. That is, as can be seen from FIG. 6, the holder 60 includes a stationary outer ring 69 and a movable inner ring 67 which is rotatably pivoted to two opposed shafts 68, 68 secured to the outer ring 69. Further, the holder 60 includes a support 65 which is rotatably pivoted to two opposed shafts 66 perpendicular to the shaft 68. The support 65 holds the pair of bending rolls 61 which hold the molding M therebetween and which are rotatable about their shafts 63, 63. Thus, the rolls 61 which are rotatable about the shaft 63, 63 are rotatable about two pairs of supporting shafts 66, 68 which are located perpendicularly to each other. The holder 60 is mounted to the frame 50 by securing the outer ring 69 of the holder 60 to the peripheral wall of the opening 50*a* of the frame 50 so that the holder 60 can rotate with the frame 50 in the directions d (FIG. 5**).

It should be noted that the first slide 30 can be replaced by the second slide 40 and vice versa. That is, it is also possible to modify the arrangement of the first slide 30 and the second slide 40 which are movable in the directions Y—Y' and Z—Z', respectively in the illustrated embodiment, in such a way that the first and second slides 30 and 40 are movable in the directions Z—Z' and Y—Y', respectively.

The apparatus according to the present invention operates as follows (FIGS. **7*a*—7*c***).

With reference to FIG. **7*a*, the molding M is bent in the horizontal direction Y—Y' by moving the bending unit 20 in the horizontal direction Y—Y'. For this purpose, the first slide 30 (FIG. 5**) moves by a predetermined distance y, in the Y—Y' direction. The radius Ry of curvature of the molding M thus bent is obtained from the following equation;

$$Ry = \frac{L^2 + y^2}{2y}$$

wherein L is a constant distance between the feeding rolls 11 and the bending rolls 61.

In FIG. **7*b*, the molding M is bent in the vertical direction Z—Z'. In this case, the second slide 40 (FIG. 5**) moves upwards by a predetermined distance z in the Z—Z' direction. The radius of curvature Rz of the bent molding M is represented by the following equation;

$$Rz = \frac{L^2 + z^2}{2z}$$

In FIG. **7*c*, the molding M is twisted about the axis X—X' thereof. For this purpose, the frame 50 (FIG. 5**) rotates by a predetermined angle $\theta$ in the counterclockwise direction.

Preferably, in order to increase the productivity of the molding, the three kinds of operations mentioned above are effected at one time.

In FIGS. **8*a*—8*c***, dimensional conditions for three different operations of the molding M are illustrated.

The desired shape of the product is determined by three factors consisting of the radii Ry and Rz, and the angle $\theta$, in relation to a length of the product in the axis X—X'. On the basis of these factors, the rotational and linear displacements of the bending rolls in the three kinds of directions are determined. The signals corresponding to the displacements are fed to the respective drives to bend and twist the molding M in the Y—Y' and Z—Z' directions and about the axis X—X', preferably at one time, respectively.

When the molding M has a certain elasticity, there may be a dimensional difference between the actual radius and an intended radius, due to a possible buckling. In such a case, it is practically preferable to determine the displacements of the bending rolls, taking a correction coefficient which is given by the intended radius divided by the actual measurement, into consideration.

Figure 8A:
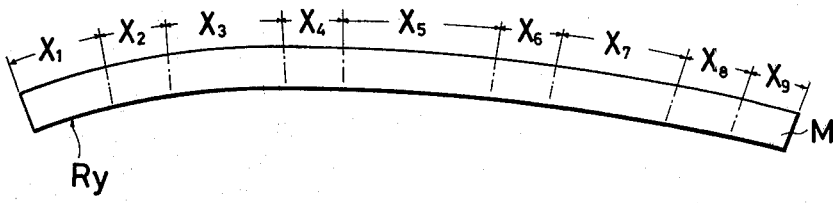
FIG. 8*a* shows a plan view of an elongated piece which is to be bent in a horizontal direction, and a table which shows bending conditions of the piece in a horizontal direction.
Figure 8B:
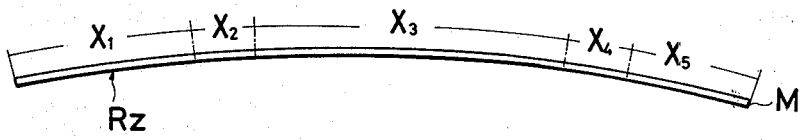
FIG. 8*b* shows a side elevational view of an elongated piece which is to be bent in a vertical direction, and a table which shows bending conditions of the piece in a vertical direction.
Figure 8C:
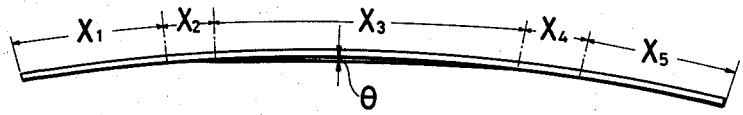
FIG. 8*c* shows a side elevational view of an elongated piece which is to be twisted about its longitudinal axis, and a table which shows twisting conditions of the piece.

It is also possible to partially change the feeding velocity (i.e. the linear velocity) of the molding M in the axial directions X—X'. The feeding velocity affects the velocities of the displacements of the bending rolls in the Y—Y' and Z—Z' directions and in the angular direction about the axis X—X'. That is, the radii decrease, the velocities of the displacements increase, and vice versa. The molding M illustrated in FIGS. **8*a*—8*c* has a gentle curve having sections of large radii of curvature. In FIGS. 8*a*—8*c*, the linear velocity of the molding M in the X—X' direction was set at 10** m/min (constant). The velocities V of the displacements of the bending rolls in the three directions are given by the following equation;

$$V\,[\text{mm/sec.}] = \frac{D\,[\text{mm}]}{Li\,[\text{mm}]} \times Vc\,[\text{mm/sec.}]$$

wherein

D is the displacement of the bending rolls,

Li is the distance of the section X1, X2–Xi–Xn,

Vc is the feeding velocity of the molding (constant).

In the tables of FIGS. 8*a*—8*c*, the arrows designate sections in which the variation is relatively small.

Figure 9:
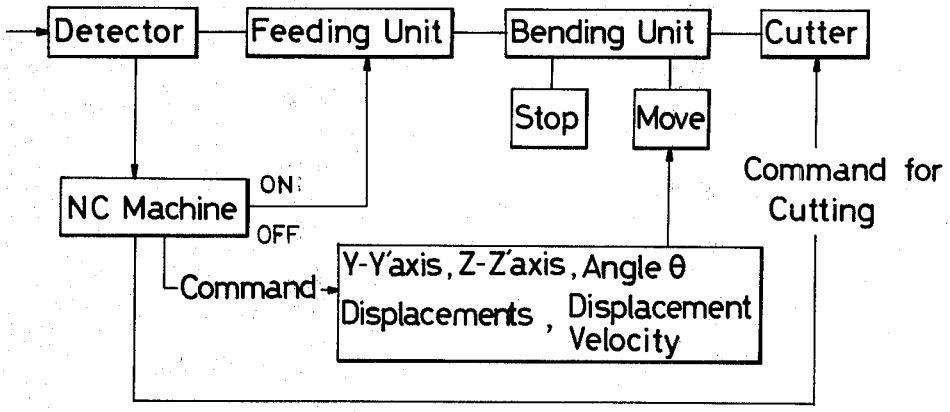
FIG. 9 is a block diagram of the arrangement in which a bending apparatus is controlled by a numerical control machine.

Finally, FIG. 9 shows a block diagram of the arrangement for controlling the bending apparatus by means of a NC machine which is per se known. The values and the velocities of the displacements are input into the NC machine. In FIG. 9, the detector detects the length of the sections of the molding M in the axial direction X—X′ from the set feeding velocity of the molding to command not only the operation of the drives of the bending unit in order to move and rotate the bending rolls in the Y—Y′ and Z—Z′ directions and about the X—X′ axis, respectively, but also the operation of the cuttor in order to cut the molding at a desired length.

What is claimed is:

1. An apparatus for bending an elongated piece which is conveyed in the longitudinal direction thereof, comprising a feeding unit having a pair of feeding rolls for feeding an elongated piece having a longitudinal axis along a path into a bending unit having a pair of bending rolls located downstream from said feeding unit, said feeding rolls and said bending rolls being arranged along said path and separated by a predetermined distance, said bending unit comprising means for displacing the bending rolls in directions perpendicular to the path to bend the elongated piece in the directions perpendicular to the longitudinal axis of the elongated piece and for rotating the bending rolls about the axis of the path extending through the nip of the bending rolls and the longitudinal axis of the elongated piece to simultaneously twist and bend the elongated piece said bending rolls serving to movably support said elongated piece so that said piece can be fed through said bending rolls for said bending and twisting operations and means to simultaneously rotate and perpendicularly move said bending rolls.

2. An apparatus according to claim 1, wherein said bending unit comprises a bed, a first slide which is movable on the bed in directions perpendicular to the path, a second slide which is movable on the first slide in directions which are different from the directions of the movement of the first slide and which are perpendicular to the path independently of the movement of the first slide, and a frame device on the second slide which rotatably holds the bending rolls.

3. An apparatus according to claim 2, wherein said first slide is movable in horizontal directions and said second slide is movable in vertical directions.

4. An apparatus according to claim 2, wherein said first slide is movable in vertical directions and said second slide is movable in horizontal directions.

5. An apparatus according to any one of claims 2–4, wherein said frame device comprises an outer ring frame which is secured to the second slide, an inner ring frame which is rotatably supported by the outer ring frame, said inner frame being rotated about an axis perpendicular to the path, and a bending roll holder which is rotatably supported by the inner ring frame and which rotatably holds the bending rolls, said bending roll holder being rotated about an axis perpendicular to the axis of the rotational movement of the inner ring frame and to the path.

* * * * *